US006014848A

United States Patent [19]

Hilburn, Jr.

[11] Patent Number: 6,014,848

[45] Date of Patent: Jan. 18, 2000

[54] RETROFIT PARKING GARAGE EXPANSION JOINT COVER

[75] Inventor: Johnnie d. Hilburn, Jr., Wichita, Kans.

[73] Assignee: Balco/Metalines, Wichita, Kans.

[21] Appl. No.: 09/182,963

[22] Filed: Oct. 30, 1998

[51] Int. Cl.[7] ..... E04B 1/68

[52] U.S. Cl. ..... 52/396.04; 52/396.05

[58] Field of Search ..... 52/396.04, 396.05; 404/68

[56] References Cited

U.S. PATENT DOCUMENTS 3,864,886 2/1975 Thom ..... 52/396.04 X 5,584,152 12/1996 Baerveldt ..... 52/396.04 X

*Primary Examiner*—Christopher T. Kent

*Attorney, Agent, or Firm*—Hovey, Williams, Timmons & Collins

[57] ABSTRACT

An expansion joint cover apparatus (10) includes a cover plate (38) in covering relationship with the gap (12) between building sections(14,16). A coupling assembly couples the first edge (46) of the plate (38) to the first building section (14) and the opposed edge (48) is slidably received in a recess (30) defined in the second building section (16) adjacent the gap (12). The coupling assembly includes a bracket having a web and a pair of spaced flanges is configured to mount to the wall face adjacent the gap of the first building section, and a bolt extending through the plate and the flanges in order to couple the plate to the first building section.

32 Claims, 1 Drawing Sheet

RETROFIT PARKING GARAGE EXPANSION JOINT COVER

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of expansion joint covers for buildings. In particular, the invention is concerned with an expansion joint cover apparatus having a cover plate in covering relationship with the gap between building sections wherein one edge of the plate is coupled to one building section and the opposed edge is slidably received in a recess defined in the second building section adjacent the gap.

2. Description of the Prior Art

The prior art concerning expansion joint covers includes a cover plate in covering relationship with an expansion gap between first and second building sections. The first edge of the plate is coupled to the first section and the opposed, second edge is slidably received in a transition recess defined in the surface of the second section adjacent the gap. The second edge slides in the recess during relative movement of the building sections caused by thermal expansion and contraction.

The second section presents a beveled recess wall at the juncture between the recess and the adjacent, upper surface of the building section. During a seismic event, the gap may narrow such that the second edge of the plate slides over the recess wall onto the upper surface of the second building section. The building sections are typically formed of concrete and the recess wall is subject to spalling, corrosion and potential impact damage from the second edge of the plate during a seismic event.

Moreover, expansion joint systems in the prior art are typically configured for installation during building construction. As a result, installation on an existing building as a retrofit can be expensive and labor intensive.

SUMMARY OF THE INVENTION

The present invention solves the prior art problems mentioned above and provides a distinct advance in the state of the art. In particular, the expansion joint apparatus hereof provides an expansion joint cover that remains effective during seismic events without damaging adjacent structural component or being exposed to damage thereby, and that can be economically installed as a retrofit to the existing building.

The preferred expansion joint cover apparatus includes a cover plate in covering relationship with the gap between building sections. One edge of the plate is coupled to one building section and the opposed edge is slidably received in a recess defined in the second building section adjacent the gap. The second building section includes a recess wall between the recess and the adjacent support surface. The apparatus further includes a transition insert mounted in the recess adjacent the recess wall. The insert presents a transition wall to provide a beveled transition between the recess area and the support surface in order to guide the plate edge therebetween during relative movement between the building sections and to protect the recess wall from impact by the second edge of the plate during such movement. In preferred forms, the transition insert is composed of metal or synthetic resin material and can be integrally formed or can be made from two components including a base and a transition body including the transition wall.

In the preferred embodiment, the first building section includes a projecting extension with a mounting recess defined in the upper surface thereof for receiving the first edge of the plate and to which the plate is coupled. In particular, the preferred coupling assembly includes a bracket with a web and a bracket flange extending therefrom wherein the web is configured to couple with the wall face adjacent the gap of the first building section. The coupling assembly also includes a bolt that extends through the plate and through the bracket flange. A nut is threaded onto the exposed end of the bolt with a resilient washer between the end of the sleeve and the nut. This allows limited rotation of the plate about the first edge during relative movement of the building sections, Other preferred aspects of the invention are disclosed herein.

DETAILED DESCRIPTION OF THE PREFERRED EMBODIMENT

Figures 1, 2:
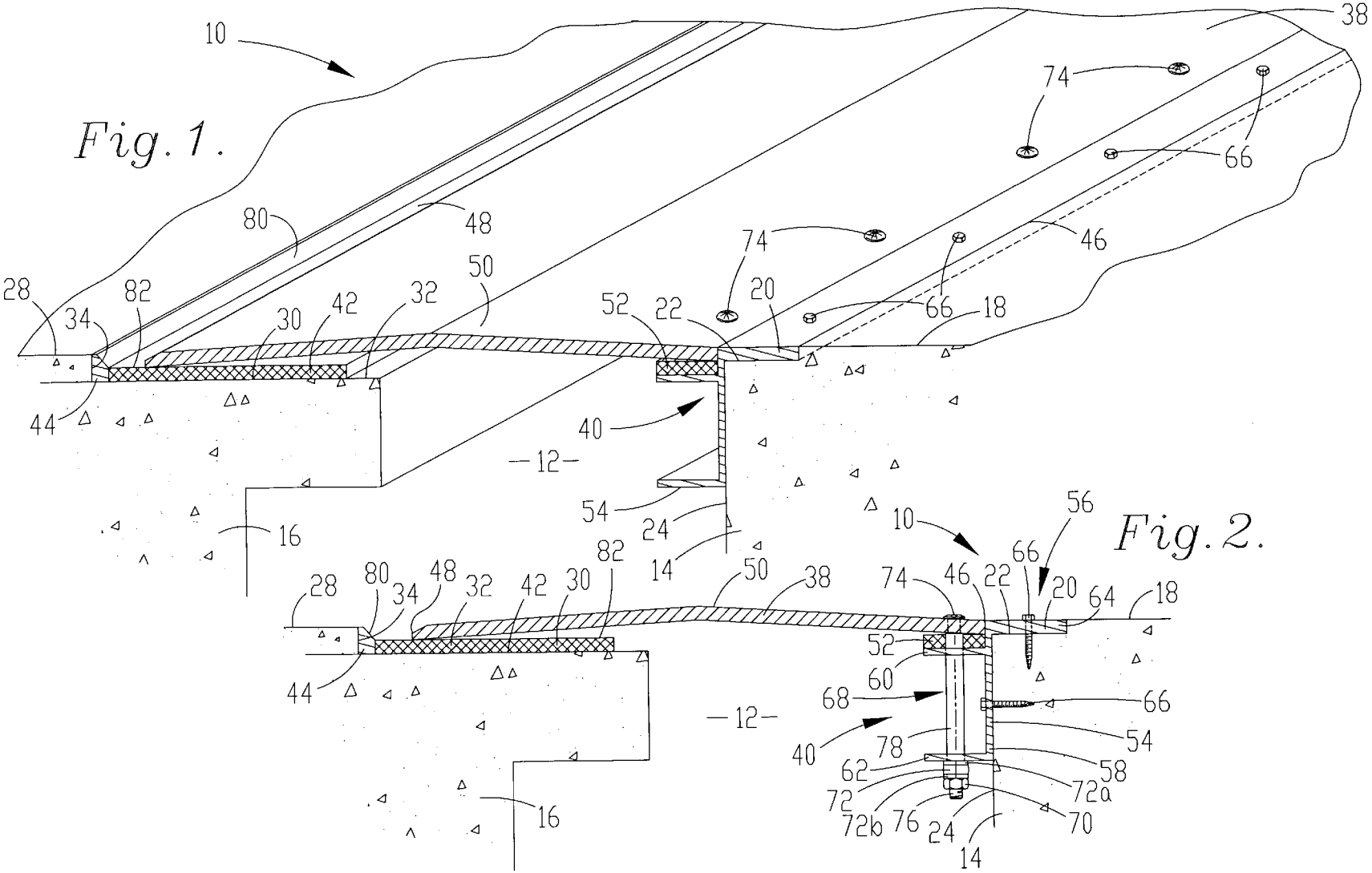
FIG. 1 is a pictorial view in partial section of the preferred expansion joint cover apparatus of the present invention shown as installed over expansion gap between adjacent building sections.
FIG. 2 is a sectional view of the installation of FIG. 1.

FIG. 1 illustrates preferred retrofit expansion joint cover apparatus 10 in accordance with the present invention. FIG. 1 shows apparatus 10 installed to span expansion gap 12 between first building section 14 and second building section 16 of a building such as a parking garage. Such building sections 14, 16 are typically composed of concrete.

First building section 14 presents first upper surface 18 and mounting recess 20 having a depth of about ¾" adjacent gap 12. Recess 20 presents support surface 22 and building section 14 presents wall face 24 adjacent gap 12.

Second building section 16 presents second upper surface 28 and is configured to define transition recess 30 having a depth of about ¾" adjacent gap 12. Recess 30 presents support area 32 below the level of 30 second upper surface 28 and includes recess wall 34 between second upper surface 28 and support area 32.

Apparatus 10 includes cover plate 38, coupling assembly 40, support pad 42 and transition insert 44. Cover plate 38 is preferably composed of ⅜" bent aluminum plate to present an arched configuration of about ½" for increased structural strength as illustrated in the drawing figures. Plate 38 extends along the length of gap 12 and is wide enough to span gap 12, and presents first edge 46 positioned in mounting recess 26 and second edge 48 positioned in transition recess 30.

Coupling assembly 40 is positioned along the length of cover plate 38 adjacent first edge 36 to couple plate 38 with first building section 14. More specifically, assembly 40 couples plate 38 to first building section 14 with first edge 46 positioned in mounting recess 20 remote from gap 14 and with upper face 50 of plate 38 substantially flush with first upper surface 18. Resilient mounting pad 52, preferably composed of neoprene about ⅜" thick, is positioned between plate 38 and support surface 22 of mounting recess 20.

Coupling assembly 40 includes mounting bracket 54 and a plurality of fasteners 56. Bracket 54 is preferably composed of aluminum and integrally includes web 58, upper bracket flange 60, lower bracket flange 62 and mounting flange 64. Spaced bracket flanges 60, 62 extend from one face of web 58 and mounting flange 64 extends from the opposite face of web 58 adjacent the upper edge thereof. As shown in FIG. 2, web 58 is configured to mount to wall face 54 with mounting flange 64 positioned in mounting recess 20. Mounting flange 64 is also ¾" thick so that the upper face thereof is flush with first upper surface 18. Upper bracket flange 60 is spaced below the level of mounting flange 64 sufficiently too accommodate mounting pad 52 and plate 38 so that upper face 50 of plate 38 is also flush with first upper surface 18.

Fasteners 56 include concrete fasteners 66, bolts 68, nuts 70 and washers 72. Concrete fasteners 66 are spaced along the length of mounting bracket 54 and couple web 58 to wall face 24 and couple mounting flange 64 to support surface 22 of mounting recess 20.

Each bolt 68 includes bolt head 74, threaded end 76, and shank 78 therebetween, and extends through cover plate 38 adjacent first edge 46, through mounting pad 52, and through bracket flanges 60, 62 so that bolt head 74 engages upper face 50 of plate 38. Bolt 68 is long enough so that threaded end 76 extends through the lower face of lower bracket flange 62. Nuts 58 are threadably received on the respective threaded ends 64 of bolts 68. A resilient washer 72 along with rigid washers 72*a* and 72*b* against opposed faces thereof are also received on the threaded end 72 of each bolt 68 snugly between lower bracket flange 62 and nut 70. The resilient nature of washer 72 allows limited rotation of plate 38 about first edge 46. For example, upward movement of second edge 48 rotates plate 38 about first edge 46. This action pulls bolts 68 upwardly to further compress washer 72. Rigid washers 72*a,b* protect resilient washer 72 during such movement. Upper rigid washer 72*a* could be eliminated if desired because of the flat surface presented by flange 62.

As will be appreciated, the configuration of coupling assembly 40 enables rapid and labor-efficient installation of apparatus 10. The only concrete work is the creation of mounting recess 20 and transition recess 30. It will be appreciated that mounting flange 64 could be tapered or beveled in order to mount directly on first upper surface 18 adjacent gap 12 thereby avoiding the need to create mounting recess 20.

Support pad 42, about ⅜" thick, is preferably composed of resilient, synthetic material such as neoprene and is positioned in transition recess 30 between second edge 48 of plate 38 and support area 32. Pad 42 supports second edge 48 for sliding thereon during relative movement between building sections 14, 16.

Transition insert 44 is integrally formed of metal such as steel or aluminum, synthetic resin material such as acrylic or hard elastomer, fiberglass or a composite material. Such materials are chosen as needed to withstand the expected loads of a particular installation. Insert 44 is positioned in transition recess 30 on support area 32 and against recess wall 34, and is beveled to present transition wall 80 configured to provide a transition between support area 32 and second upper surface 28. In particular, wall 80 provides a transition between upper face 82 of support pad 42 and second upper surface 28.

In the preferred embodiment, transition recess 30 is wide enough so that second edge 48 remains therein supported by support pad 42 during expected widening and narrowing of gap 12 due to thermal expansion and contraction. However, during a seismic event, building sections 14, 16 may move toward one another by an amount so that second edge 42 slides over transition wall 80 onto second upper surface 28. During such movement, transition wall 66 guides second edge 48 between support area 32 and second upper surface 28.

Insert 44 is preferably composed of materials less subject to spalling and corrosion and the concrete making up recess wall 34. Because of this, insert 44 ensures reliable operation of apparatus 10 over the many years that the building may be in service. Moreover, insert 44 protects recess wall 34 from impact damage by second edge 48 during a seismic event.

As those skilled in the art will appreciate, the present invention encompasses many variations in the preferred embodiments described herein. For example, the transition wall can present angles other than the preferred 45 degrees and a wide variety of known fastening techniques can be used to couple the cover plate with the first building section. Other variations can include different shapes of the various recesses. Also, the insert need not be integral but could be composed of separate, bonded pieces. Having thus described the preferred embodiments of the present invention, the following is claimed as new and desired to be secured by Letters Patent:

I claim:

1. An expansion joint cover apparatus for use in covering a gap between first and second building sections presenting respective first and second support surfaces, the second building section being configured to define a transition recess adjacent the gap presenting a support area below the level of the second support surface and including a recess wall between the second support surface and the recess support area, said apparatus comprising:

a cover plate having a plate width adapted tube greater than the width of the gap, said plate presenting a first edge and an opposed second edge;

coupling means for coupling said plate adjacent said first edge thereof with the first section adjacent the gap, for positioning said plate in covering relationship with the gap and positioning said second edge in said recess, said second edge being slidable in said recess and slidable between the recess and the second support surface during relative movement of the building sections; and a transition insert configured to mount in the transition recess adjacent the recess wall and including an insert wall configured to provide a beveled transition between the support area and the second-support surface in order to guide said second edge therebetween during relative movement of the building sections and to protect the recess wall from impact by said second edge during said movement, said coupling means including a mounting bracket and a plate fastener, said plate presenting an upper face, the first building section presenting a wall face adjacent the gap, said bracket including a web and a bracket flange for extending therefrom, said web being configured to couple with the wall face and to position said bracket flange extending into the gap below the level of the first support surface, said plate fastener and bracket being configured to couple said plate to said bracket flange so that said upper face of said plate is substantially flush with the first support surface.

2. The apparatus of claim 1, said fastener including a bolt, a nut and a washer.

3. The apparatus of claim 2, said bracket flange being an upper bracket flange, said bracket including a lower bracket flange extending from said web substantially parallel to said upper bracket flange and spaced therefrom, said bolt including a bolt head and a threaded end with a shank therebetween, said bracket flanges and plate being apertured in registration to receive said bolt through said plate with said bolt head against said upper face thereof, with said shank extending through said plate and bracket flanges, and with said threaded end extending from the lower face of said lower bracket, said nut being configured for threaded reception on said threaded end with said washer between said nut and said lower bracket flange, said coupling means including a plurality of said bolts, nuts and washers.

4. The apparatus of claim 3, said washer being a resilient washer to allow limited rotation of said plate about said first edge, said apparatus further including a rigid washer positioned between said resilient washer and said nut.

5. The apparatus of claim 4, said web including an upper edge, said bracket including a mounting flange extending from said upper edge opposite said bracket flanges, the first support surface being recessed adjacent the gap to present a mounting recess, said mounting flange being configured for reception in the mounting recess with the upper surface of said mounting flange substantially flush with the first support surface.

6. The apparatus of claim 5, said upper bracket flange being configured for supporting said plate with said upper face thereof substantially flush with said mounting flange.

7. The apparatus of claim 6, said coupling means further including a resilient mounting pad configured for positioning between said plate and said upper bracket flange.

8. The apparatus of claim 7, said mounting pad being composed of neoprene.

9. The apparatus of claim 1, said web including an upper edge, said bracket including a mounting flange extending from said upper edge opposite said bracket flanges, the first support surface being recessed adjacent the gap to present a mounting recess, said mounting flange being configured for reception in the mounting recess with the upper surface of said mounting flange substantially flush with the first support surface.

10. The apparatus of claim 9, said upper bracket flange being configured for supporting said plate with said upper face thereof substantially flush with said mounting flange.

11. The apparatus of claim 1, said cover plate presenting an arched configuration.

12. The apparatus of claim 1, said cover plate being composed of metal.

13. The apparatus of claim 12, said cover plate being composed of aluminum.

14. The apparatus of claim 1, said insert being composed of one of metal and synthetic resin material.

15. The apparatus of claim 14, said metal including one of steel and aluminum, said synthetic resin material including acrylic.

16. The apparatus of claim 1, said insert wall configured to present an angle of about 45 degrees relative to the second support surface.

17. In combination:

first and second building sections presenting respective first and second support surfaces, said building sections being spaced to present a gap therebetween, the first building section presenting a wall face adjacent the gap and being configured to define a mounting recess in the first support surface adjacent the gap, the second building section being configured to define a transition recess adjacent the gap presenting a support area below the level of the second support surface and including a recess wall between the second support surface and the recess support area; and an expansion joint cover apparatus covering said gap, said apparatus including a cover plate having a plate width greater than the width of the gap, said plate presenting a first edge and an opposed second edge;

coupling means coupling said plate adjacent said first edge thereof with the first section adjacent the gap, positioning said plate in covering relationship with the gap and positioning said second edge in said transition recess; and a transition insert mounted in the recess adjacent the recess wall and including a transition wall presenting a beveled transition between the recess area and the second support surface in order to guide said second edge therebetween during relative movement of the building sections and to protect the recess wall from impact by said second edge during said movement, said coupling means including a mounting bracket and a plate fastener, said plate presenting an upper face, said bracket including a web and a bracket flange extending therefrom, said web being configured to couple with the wall face and to position said bracket flange extending into the gap below the level of the first support surface, said plate fastener and bracket being configured to couple said plate to said bracket flange so that said upper face of said plate is substantially flush with the first support surface.

18. The apparatus of claim 17, said fastener including a bolt, a nut and a washer.

19. The apparatus of claim 18, said bracket flange being an upper bracket flange, said bracket including a lower bracket flange extending from said web substantially parallel to said upper bracket flange and spaced therefrom, said bolt including a bolt head and a threaded end with a shank therebetween, said bracket flanges and plate being apertured in registration to receive said bolt through said plate with said bolt head against said upper face thereof, with said shank extending through said plate and bracket flanges, and with said threaded end extending from the lower face of said lower bracket, said nut being configured for threaded reception on said threaded end with said washer between said nut and said lower bracket flange, said coupling means including a plurality of said bolts, nuts and washers.

20. The apparatus of claim 19, said washer being a resilient washer to allow limited rotation of said plate about said first edge, said apparatus further including a rigid washer positioned between said resilient washer and said nut.

21. The apparatus of claim 20, said web including an upper edge, said bracket including a mounting flange extending from said upper edge opposite said bracket flanges, the first support surface being recessed adjacent the gap to present a mounting recess, said mounting flange being received in the mounting recess with the upper surface of said mounting flange substantially flush with the first support surface.

22. The apparatus of claim 21, said upper bracket flange supporting said plate with said upper face thereof substantially flush with said mounting flange.

23. The apparatus of claim 22, said coupling means further including a resilient mounting pad positioned between said plate and said upper bracket flange.

24. The apparatus of claim 23, said mounting pad being composed of neoprene.

25. The apparatus of claim 17, said web including an upper edge, said bracket including a mounting flange extending from said upper edge opposite said bracket flanges, the first support surface being recessed adjacent the gap to present a mounting recess, said mounting flange being received in the mounting recess with the upper surface of said mounting flange substantially flush with the first support surface.

26. The apparatus of claim 25, said upper bracket flange for supporting said plate with said upper face thereof substantially flush with said mounting flange.

27. The apparatus of claim 17, said cover plate presenting an arched configuration.

28. The apparatus of claim 17, said cover plate being composed of metal.

29. The apparatus of claim 28, said cover plate being composed of aluminum.

30. The apparatus of claim 17, said insert being composed of one of metal and synthetic resin material.

31. The apparatus of claim 30, said metal including one of steel and aluminum, said synthetic resin material including acrylic.

32. The apparatus of claim 17, said insert wall presenting an angle of about 45 degrees relative to the second upper surface.

* * * * *